US006868955B2

(12) United States Patent
Mikami et al.

(10) Patent No.: US 6,868,955 B2
(45) Date of Patent: Mar. 22, 2005

(54) COIN PROCESSING DEVICE

(75) Inventors: Mitsugu Mikami, Kawagoe (JP); Yoshikazu Mori, Saitama (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 142 days.

(21) Appl. No.: 10/001,370

(22) Filed: Oct. 25, 2001

(65) Prior Publication Data

US 2002/0060122 A1 May 23, 2002

(30) Foreign Application Priority Data

Nov. 9, 2000 (JP) ..... 2000-341921

(51) Int. Cl.[7] ..... G07F 9/10
(52) U.S. Cl. ..... 194/350; 194/302
(58) Field of Search ..... 194/302, 215, 194/216, 224, 239, 240; 453/1, 2, 3, 58; 73/163

(56) References Cited

U.S. PATENT DOCUMENTS 4,465,173 A * 8/1984 Domen et al. ..... 194/302
4,969,549 A * 11/1990 Eglise ..... 194/205
6,026,367 A * 2/2000 Hjelmvik ..... 705/13
6,309,098 B1 * 10/2001 Wong ..... 368/94

FOREIGN PATENT DOCUMENTS

GB 2153128 A * 8/1985 ..... G07F/7/00
JP 10-320607 12/1998
JP 11-019330 1/1999
JP 11-019330 A * 1/1999 ..... A64F/9/00

* cited by examiner

*Primary Examiner*—Donald P. Walsh
*Assistant Examiner*—Mark J. Beauchaine
(74) *Attorney, Agent, or Firm*—Welsh & Katz, Ltd.

(57) ABSTRACT

A coin processing device, which ascertains genuine or counterfeit nature and denomination of inserted coins, accommodates coins that have been ascertained to be genuine according to denomination and pays out the accommodated coins via a coin pay-out slot according to amount of change, includes a coin-type IC card processor for ascertaining genuine or counterfeit nature of inserted coin-type IC cards, performing input and output of information into and from coin-type IC card that have been ascertained to be genuine and discharging the coin-type IC cards from the coin pay-out slot, whereby the coin processing device processes both the coins and coin-type IC cards.

1 Claim, 6 Drawing Sheets

COIN PROCESSING DEVICE

BACKGROUND OF THE INVENTION

1. Field of the Invention

The present invention relates to a coin processing device which is used in automatic vending machines, money change machines, service machines and the like, and which can employ the so-called point system.

2. Description of the Related Art

Generally, automatic vending machines, money change machines, service machines and the like (hereafter referred to simply as "automatic vending machines") are provided with coin processing devices which discriminate and accommodate coins inserted from a coin insertion slot according to denomination, and pay out discriminated and accommodated coins in accordance with the amount of change.

Conventional coin processing devices of this type ordinarily comprise coin discriminating means for ascertaining whether an inserted coin is genuine or counterfeit and the denomination the coin, coin accommodating means for accommodating only coins that have been ascertained to be genuine, according to the denomination of these coins, and coin pay-out means for paying out accommodated coins only as change in accordance with transaction information of goods. In such coin processing devices, these means process only coins.

On the other hand, a so-called point system has been used in recent years in shops and stores to promote their commercial transactions. The point system is a system in which monetary information relating to commercial transactions such as the amount of money paid to the store by a consumer who purchased goods at the store is recorded in the form of points (point information) on a card (point card), and the amount to be paid to the store is discounted at the time of subsequent transactions on the basis of the point information. In cases where this point system is introduced into an automatic vending machine, it is necessary to input and output monetary information into and from this card. Accordingly, a special reader-writer which performs the input and output of information into and from the card is newly installed inside the automatic vending machine separately from the conventional coin processing device.

As the point card, a so-called coin-type IC card is ordinarily used. The coin-type IC card has a disk-form body, i.e., a coin type body in which an IC chip module that records, calculates and processes various types of information including monetary information, and an antenna coil or the like which supplies electric power and inputs and outputs information for the IC chip in a non-contact manner, are embedded.

SUMMARY OF THE INVENTION

The present invention is a coin processing device which is devised so that the genuine or counterfeit nature and denomination of inserted coins are ascertained, coins that have been ascertained to be genuine are accommodated according to the denomination of the coins, and these accommodated coins are paid out from a coin pay-out slot in accordance with the amount of change, wherein coin-type IC card processing means are provided for ascertaining the genuine or counterfeit nature of an inserted coin-type IC card, performing the input and output of information into and from coin-type IC cards that have been ascertained to be genuine, and discharging the coin-type IC cards from the abovementioned coin pay-out slot, and wherein the abovementioned coins and coin-type IC cards are processed.

DESCRIPTION OF THE PREFERRED EMBODIMENTS

Below, one embodiment of the coin processing device of the present invention will be described in detail.

Figure 1:
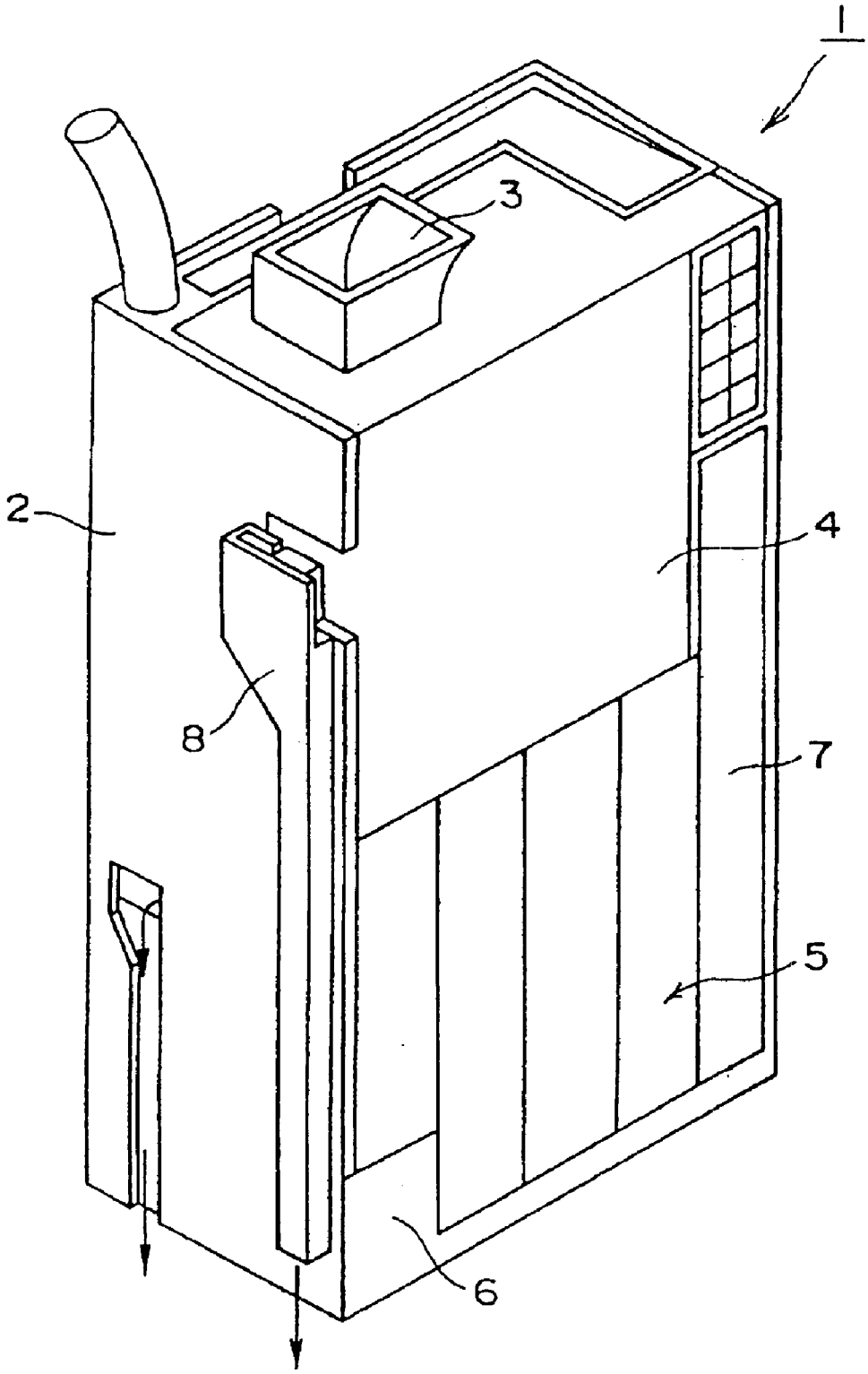
FIG. 1 is a schematic perspective view of a coin processing device according to one embodiment of the present invention.

FIG. 1 is a schematic perspective view of the coin processing device according to an embodiment of the present invention.

The coin processing device 1 comprises a device main body 2 which forms a housing body, a coin discrimination unit 4 which is disposed in the uppermost part of the housing main body 2, and which ascertains the genuine or counterfeit nature of coins inserted via a coin insertion slot 3, and the denomination of genuine coins, a coin accommodating unit 5 arranged below the coin discrimination unit 4 and comprising a plurality of coin tubes which respectively accommodate coins that have been ascertained to be genuine by the coin discrimination unit 4 according to the denomination of these coins, and a coin pay-out unit 6 which is disposed beneath the coin accommodating unit 5, and which pays out genuine coins from the coin accommodating unit 5 in accordance with the amount of change. Among these units, the coin accommodating unit is equipped with an auxiliary tube 7 which accommodates coins with a high frequency of use beforehand.

Furthermore, the reference symbol 8 in FIG. 1 indicates a liquid discharge tube which expels liquid matter (liquids such as detergents or the like) that has entered the interior of the coin processing device 1 to the outside of the coin processing device 1.

Next, the coin discrimination unit 4 of the coin processing device 1 will be described in detail.

Figure 2:
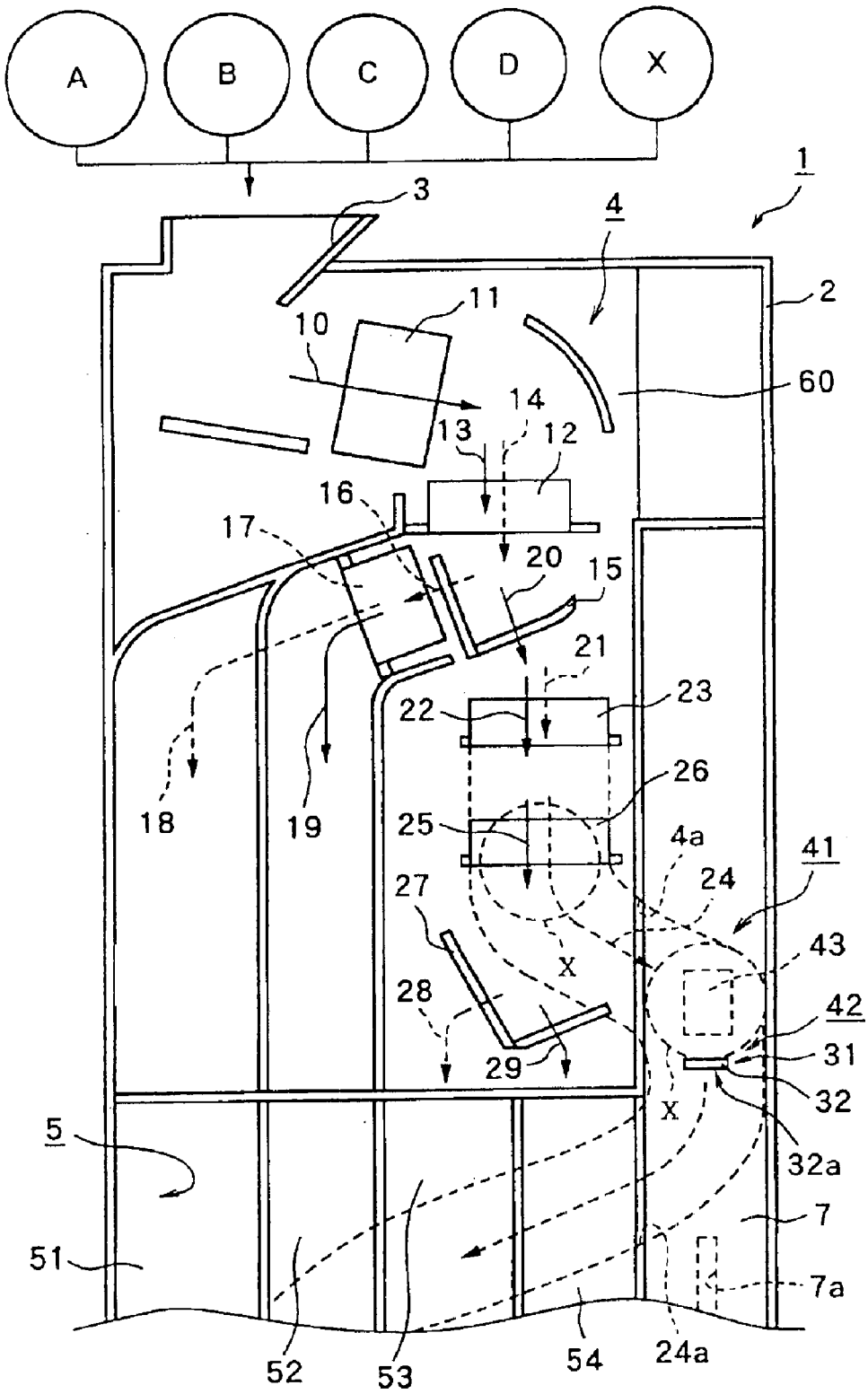
FIG. 2 is a schematic front view of essential parts of the coin processing device shown in FIG. 1.

FIG. 2 is a schematic front view of the essential parts of the coin processing device 1.

The coin discrimination unit 4 of the coin processing device 1 discriminates between four types of genuine coins with different diameters, i.e., genuine coins of type A, genuine coins of type B, genuine coins of type C and genuine coins of type D, and counterfeit coins. Furthermore, the coin discrimination unit 4 also discriminates between genuine and counterfeit coin-type IC cards X.

A discriminating passage 10 which is inclined toward the right in the figures is formed directly beneath the coin insertion slot 3 of the coin discrimination unit 4, and a discriminating sensor 11 is disposed at an intermediate point in the discriminating passage 10.

The discriminating sensor 11 is constructed from a known sensor (coil sensor) which ascertains whether or not a disk-form body that is inserted via the coin insertion slot 3 and guided along the discriminating passage 10 is a coin of type A, B, C or D, i.e., ascertains whether such a disk-form body is a genuine or counterfeit coin of one of the abovementioned types, and which ascertains the denomination of the coin in cases where it is ascertained that this disk-form body is a genuine coin. This discriminating sensor 11 can also discriminate between genuine and counterfeit coin-type IC cards X.

On the other hand, a known genuine/counterfeit sorting lever 12 whose upper end opens and closes in the vertical direction (with respect to the figures) about the axis of the lower end is disposed at the terminal end of the discriminating passage 10, and the terminal end of the discriminating passage 10 is caused to branch into a counterfeit coin discharge passage 13 which guides counterfeit coins and counterfeit coin-type IC cards, and a first passage 14 which guides genuine coins of types A, B, C and D and genuine coin-type IC cards X, by the abovementioned genuine/counterfeit sorting lever 12.

Furthermore, the counterfeit coin discharge passage 13 communicates with a counterfeit coin discharge chute (not shown in the figures) formed in the front surface side of a main plate 60, i.e., in the front surface side of the coin discrimination unit 4 shown in FIG. 1, and this counterfeit coin discharge chute communicates with the coin pay-out slot (not shown in the figures).

Meanwhile, a known first sorting lever 15 whose overall shape is substantially L-shaped as seen in a front view is disposed in the first passage 14 shown in FIG. 2. By means of the first sorting lever 15, the terminal end of the first passage 14 is caused to branch into a second passage 16 which is inclined toward the left in the figures, and a third passage 20 which is inclined slightly toward the right in the figures. The second passage 16 is a passage which guides coins of types A and C, and the third passage 20 is basically a passage which guides coins of types B and D and genuine coin-type IC cards X.

When the first sorting lever 15 protrudes from the main plate 60, the second passage 16 located to one side of the lever 15 is opened, and the third passage 20 located at the bottom surface of the lever 15 is closed. On the other hand, when the first sorting lever 15 is sucked toward the main plate 60, the second passage 16 is closed, and the third passage 20 is opened.

Furthermore, a known second sorting lever 17 whose right end opens and closes in the vertical direction (with respect to the figures) about the axis of the left end is disposed at the downstream end of the second passage 16. By means of the second sorting lever 17, the terminal end of the second passage 16 is caused to branch into a fourth passage 18 which guides coins of type A, and a fifth passage 19 which is disposed on the front surface side of the main plate 60 with respect to the fourth passage 18, and which guides coins of type C.

Furthermore, a known third sorting lever 23 whose upper end opens and closes in the vertical direction (with respect to the figures) about the axis of the lower end is disposed at the downstream end of the third passage 20. By means of the third sorting lever 23, the terminal end of the third passage 20 is caused to branch into a sixth passage 21 which is formed on the back surface side of the main plate 60, and which leads to a cash box (not shown in the figures), and a seventh passage 22 which is disposed on the front surface side of the main plate 60, opposing to the sixth passage 21, and which guides coins of types B and D and genuine coin-type IC cards X.

Incidentally, the sixth passage 21 is a passage which guides coins of various types that are subsequently inserted into the abovementioned cash box in cases where the coins of types A, C, B and D accommodated in the respective coin tubes 51, 52, 53 and 54 of the coin accommodating unit 5 (described later) have respectively reached fixed numbers of accommodated coins.

Furthermore, a fourth sorting lever 26 whose upper end opens and closes in the vertical direction (with respect to the figures) about the axis of the lowered is disposed at the downstream end of the seventh passage 22. By means of the fourth sorting lever 26, the terminal end of the seventh passage 22 is caused to branch into an eighth passage 24 which guides genuine coin-type IC cards X, and a ninth passage 25 which is disposed on the front surface side of the main plate 60 with respect to the eighth passage 24, and which guides coins of type B and coins of type D.

Furthermore, a known fifth sorting lever 27 which has the same structure as the first sorting lever 15 is disposed at the downstream end of the ninth passage 25. By means of the fifth sorting lever 27, the terminal end of the ninth passage 25 is caused to branch into a tenth passage 28 which is inclined toward the left with respect to the figures, and an eleventh passage 29 which is inclined slight toward the right with respect to the figures. The tenth passage 28 is a passage that guides coins of type B, and the eleventh passage 29 is a passage that guides coins of type D.

When the fifth sorting lever 27 protrudes from the main plate 60, the tenth passage 28 which is located to one side of the lever 27 is opened, and the eleventh passage 29 which is located at the bottom surface of the lever 27 is closed. On the other hand, when the fifth sorting lever 27 is sucked toward the main plate 60, the tenth passage 28 is closed, and the eleventh passage 29 is opened.

Meanwhile, as is shown in FIG. 1, the eighth passage 24 is extended into the interior of the auxiliary tube 7 of the coin accommodating unit 5 via a hole 4*a* formed in the coin discrimination unit 4, and is further extended toward the respective coin tubes 51, 52, 53 and 54 (described later). Furthermore, the downstream end of the eighth passage 24 communicates with the abovementioned counterfeit coin discharge chute.

Furthermore, information input/output means 42 for inputting and outputting information into and from genuine coin-type IC cards X that are sent into the eighth passage 24 are disposed in the portion of the eighth passage 24 that is positioned upstream from the inside of the auxiliary tube 7.

The information input/output means 42 comprise retention means 31 for temporarily retaining coin-type IC cards X, and antenna coils 43 of a control device (not shown in the figures) which inputs and outputs information into and from the coin-type IC cards X that have been temporarily retained by the retention means 31.

Figure 3:
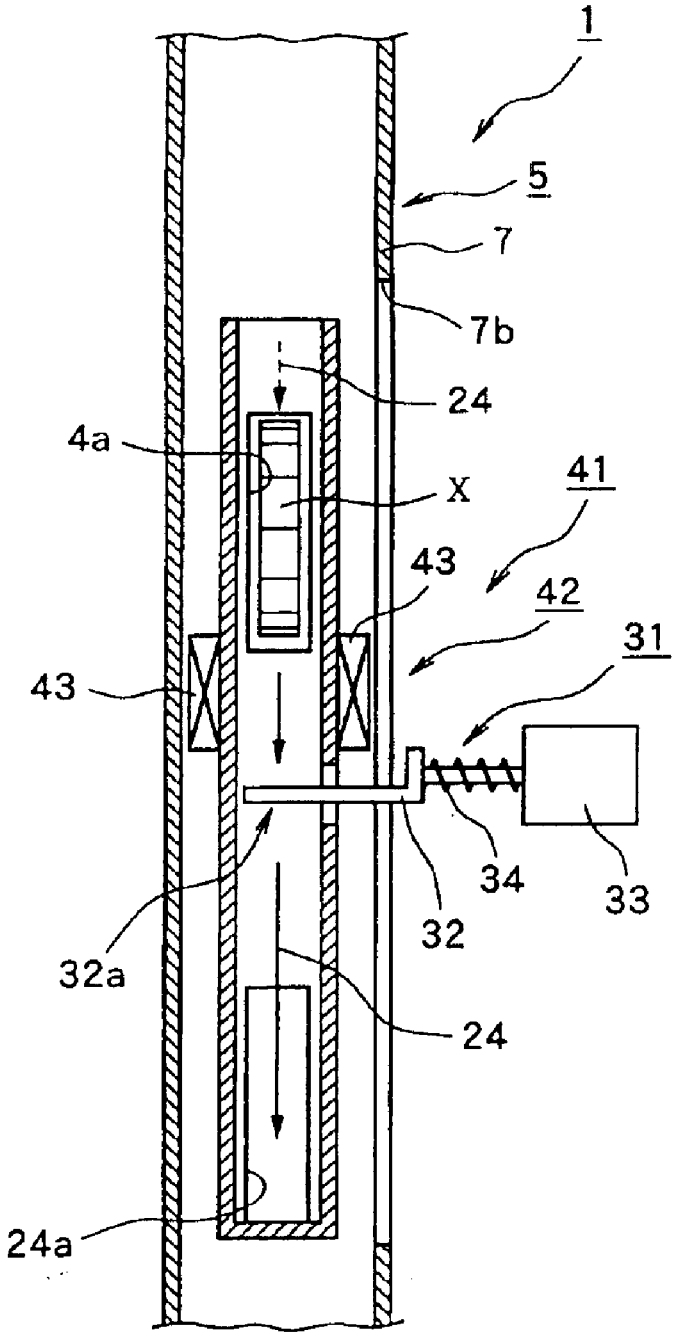
FIG. 3 is a schematic sectional view of essential parts of the coin processing device shown in FIG. 1, which illustrates the processing of a coin-type IC card.

Here, as is seen from FIG. 3 which shows a schematic sectional view of the essential parts of the coin processing device 1 shown in FIG. 2, the retention means 31 comprise a retention lever 32, a solenoid 33 which operates the retention lever 32, and a spring 34 which is fit over the drive shaft of the abovementioned solenoid 33.

Figure 4:
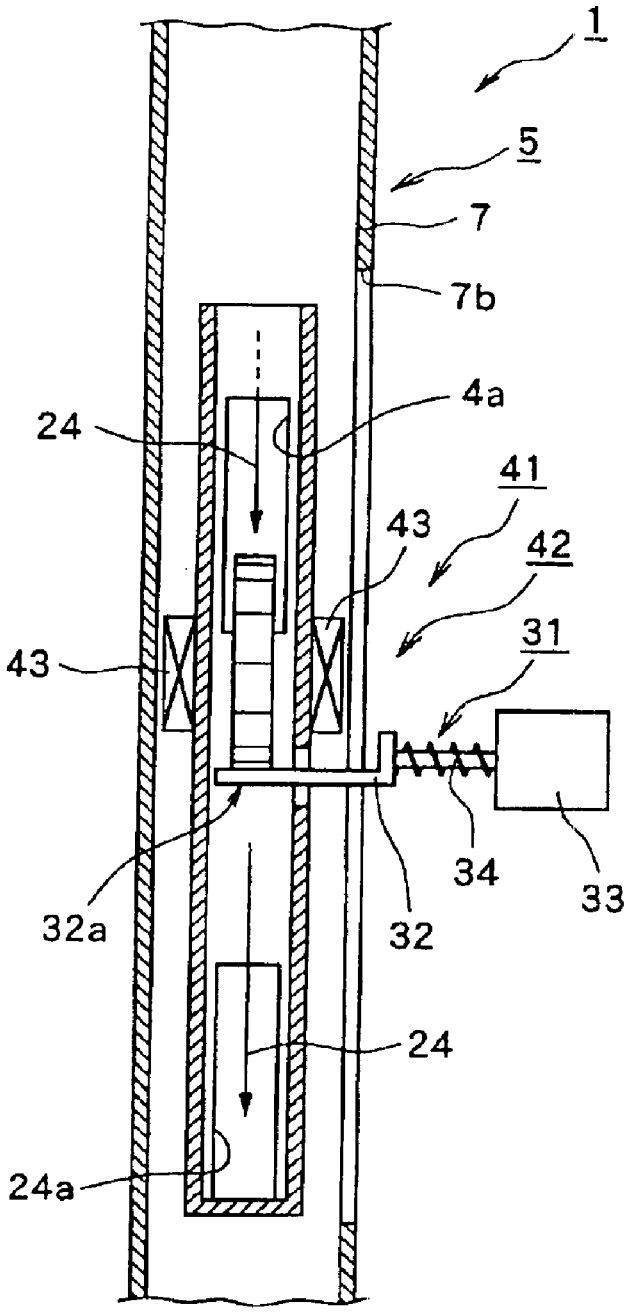
FIG. 4 is a schematic sectional view of essential parts of the coin processing device shown in FIG. 1, which illustrates the processing of a coin-type IC card.

In the retention means 31, the tip end 32*a* of the retention lever 32 protrudes into the eighth passage 24 as shown in FIG. 3 in the initial state in which the solenoid 33 is "off". Accordingly, in this case, when a coin-type IC card X is guided into the retention means 31, the tip end 32*a* of the retention lever 32 supports the circumferential surface of the coin-type IC card X as shown in FIG. 4, so that this coin-type IC card X is retained.

Figure 5:
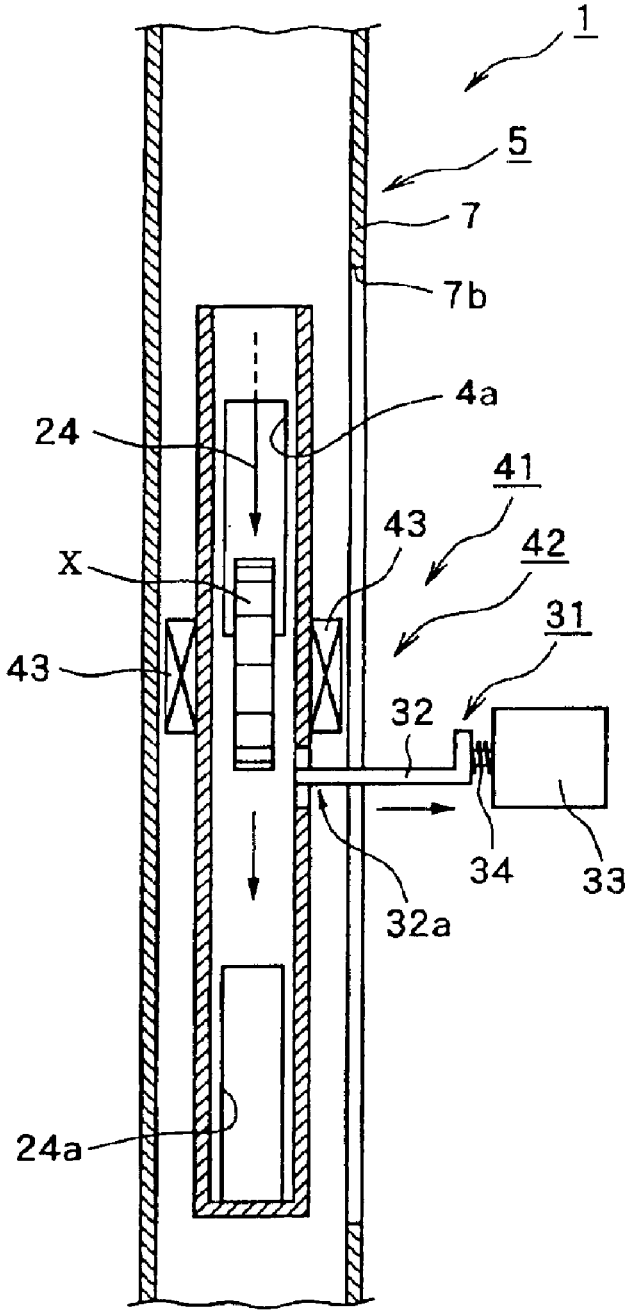
FIG. 5 is a schematic sectional view of essential parts of the coin processing device shown in FIG. 1, which illustrates the processing of a coin-type IC card.
Figure 6:
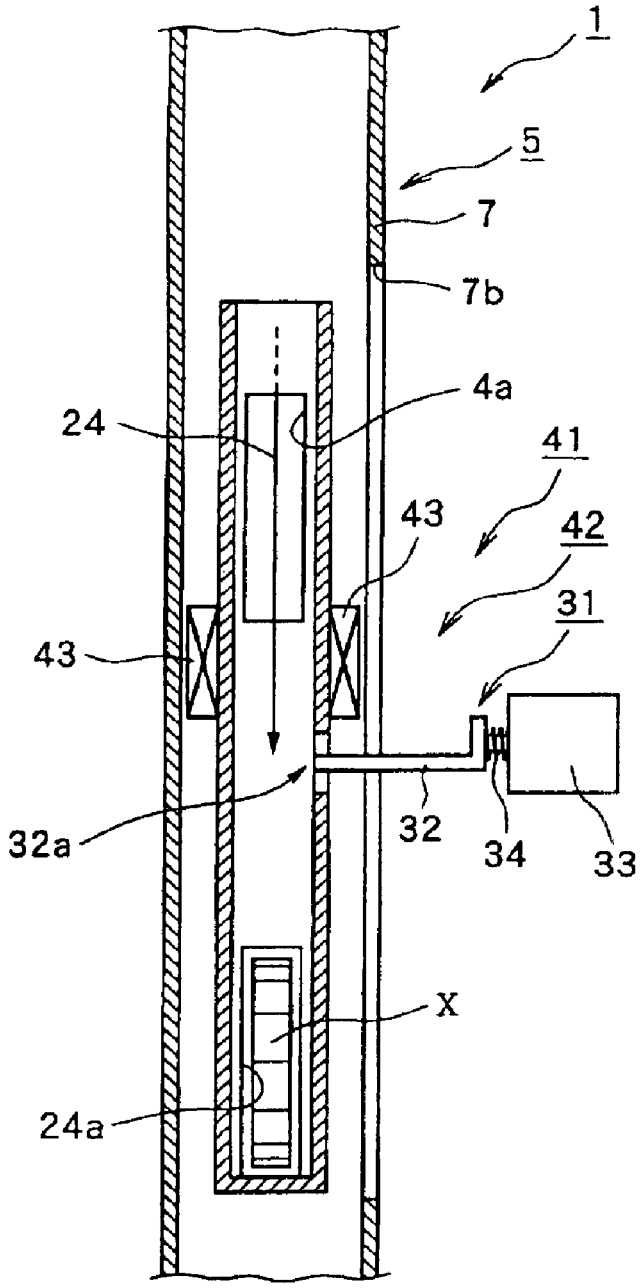
FIG. 6 is a schematic sectional view of essential parts of the coin processing device shown in FIG. 1, which illustrates the processing of a coin-type IC card.

Furthermore, when the solenoid 33 is switched "on" on the basis of a driving signal from the control device (not shown in the figures), the tip end 32*a* of the retention lever 32 is retracted from the interior of the eighth passage 24 as shown in FIG. 5, so that the upstream side of the eighth passage 24 is opened. As a result, the coin-type IC card X that had been retained up to this point is guided toward the downstream side of the eighth passage 24 as shown in FIG. 6.

Meanwhile, the antenna coils 43 are disposed facing each other on both sides of the eighth passage 24 that is located in a position slightly upstream from the retention means 31.

Furthermore, the genuine/counterfeit sorting lever 12 and first through fifth sorting levers 15, 17, 23, 26 and 27 are respectively opened and closed by solenoids not shown in the figures.

Next, the coin accommodating unit 5 of the coin processing device 1 shown in FIG. 2 will be described in detail.

The coin accommodating unit 5 accommodates four type of genuine coins of different diameters, i.e., genuine coins of type A, genuine coins of type B, genuine coins of type C and genuine coins of type D; furthermore, the coin accommodating unit 5 also accommodates specified coin-type IC cards X.

The coin accommodating unit 5 comprises a coin tube 51 which accommodates coins of type A, a coin tube 52 which accommodates coins of type C, a coin tube 53 which accommodates coins of type B, a coin tube 54 which accommodates coins of type D, and the abovementioned auxiliary tube 7 (see FIGS. 1 and 2).

Of these tubes, the coin tube 51 is disposed at the downstream end of the fourth passage 18.

Furthermore, the coin tube 52 is disposed at the downstream end of the fifth passage 19. The coin tube 53 is disposed at the downstream end of the tenth passage 28. The coin tube 54 is disposed at the downstream end of the eleventh passage 29.

Furthermore, the eighth passage 24 is disposed inside the auxiliary tube 7.

Ordinarily, coins with a high frequency of use are accommodated beforehand inside the auxiliary tube 7. However, in the case of the coin processing device 1 of the present embodiment, coin-type IC cards X are accommodated inside the auxiliary tube 7. In the coin-type IC cards, monetary information is recorded beforehand as numbers of points.

As is shown in FIG. 2, a coin insertion slot 7*a* which is used to insert the abovementioned coins into the auxiliary tube 7 is disposed in a portion of the auxiliary tube 7 that is positioned downstream from the eighth passage 24.

Next, the coin pay-out unit 6 of the coin processing device 1 will be described in detail.

The coin pay-out unit 6 pays out coins of type A, coins of type C, coins of type B and coins of type D from the coin tubes 51, 52, 53 and 54 of the coin accommodating unit 5, respectively, in accordance with the amount of change. The coin pay-out unit 6 also pays out coin-type IC cards X accommodated in the auxiliary tube 7 into the coin pay-out slot.

Furthermore, the coin pay-out unit 6 pays out coins with a high frequency of use that are ordinarily accommodated in the auxiliary tube 7 into the coin pay-out slot.

In the coin processing device constructed as described above, the abovementioned discriminating sensor 11, fourth sorting lever 26, information input/output means 42, auxiliary tube 7 and coin pay-out unit 6 constitute coin-type IC card processing means 41 for discriminating between genuine and counterfeit coin-type IC cards X inserted via the coin insertion slot 3, inputting and outputting information into and from coin-type IC cards X that have been ascertained to be genuine, and discharging the coin-type IC cards X from the coin pay-out slot.

In particular, the discriminating sensor 11 constitutes discriminating means of the coin-type IC card processing means 41 for discriminating between genuine and counterfeit coins that are inserted and ascertaining the denomination of genuine coins, and for discriminating between genuine and counterfeit coin-type IC cards X. Furthermore, the fourth sorting lever 26 constitutes sorting means of the coin-type IC card processing means 41 for guiding genuine coin-type IC cards X to a specified passage (eighth passage 24) which communicates with the coin pay-out slot.

Furthermore, the information input/output means 42 are disposed at an intermediate point in the abovementioned specified passage, and constitute information input/output means of the coin-type IC card processing means 41 for inputting and outputting information into and from genuine coin-type IC cards X. Moreover, the auxiliary tube 7 constitutes coin-type IC card accommodating means of the coin-type IC card processing means 41 for accommodating coin-type IC cards X beforehand. Furthermore, the coin pay-out unit 6 constitutes coin-type IC card pay-out means of the coin-type IC card processing means 41 for paying out coin-type IC cards X accommodated in the coin-type IC card accommodating means.

Next, the operation of the coin processing device 1 will be described, and the construction of this coin processing device 1 will also be described in greater detail.

When a disk-form body is inserted into the coin insertion slot 3 shown in FIG. 1, this disk-form body is guided into the discriminating passage 10, and it is ascertained by the discriminating sensor 11 whether or not this disk-form body is a coin of type A, coin of type B, coin of type C or coin of type D, i.e., whether the disk-form body is a genuine coin of one of these coin types, or a counterfeit coin. Furthermore, in cases where the disk-form body is ascertained to be a genuine coin, the denomination of this coin is also ascertained. Furthermore, it is also ascertained by the discriminating sensor 11 whether or not this disk-form body is a genuine coin-type IC card.

On the other hand, when it is judged on the basis of the detection signal of the discriminating sensor 11 that an inserted disk-form body is a counterfeit coin or a counterfeit coin-type IC card, the control device (not shown in the figures) actuates the genuine/counterfeit sorting lever 12 on the basis of a judgement signal from the control device, so that the upstream end of the counterfeit coin discharge passage 13 is opened, and so that the upstream end of the first passage 14 is simultaneously closed. As a result, the counterfeit coin or counterfeit coin-type IC card that rolls through the discriminating passage 10 is guided into the counterfeit coin discharge passage 13 by the genuine/counterfeit sorting lever 12, and is returned to the coin pay-out slot (not shown in the figures) via the discharge chute (not shown in the figures).

Furthermore, in cases where it is judged on the basis of the detection signal of the discriminating sensor 11 that an inserted disk-form body is a genuine coin and is moreover a coin of type A, the control device (not shown in the figures) actuates the genuine/counterfeit sorting lever 12 on the basis of a judgement signal from the control device, so that the upstream end of the counterfeit coin discharge passage 13 is closed, and so that the upstream end of the first passage 14 is simultaneously opened. At the same time, the first sorting lever 15 is actuated so that the upstream end of the second passage 16 is opened and the upstream end of the third passage 20 is closed. Furthermore, the second sorting lever 17 is actuated so that the upstream end of the fourth passage 18 is opened and the upstream end of the fifth passage 19 is closed.

Accordingly, a coin of type A which is inserted into the coin insertion slot 3 so that this coin rolls through the discriminating passage 10 is guided into the first passage 14 by the genuine/counterfeit sorting lever 12, and is then guided into the second passage 16 by the first sorting lever 15. Furthermore, the coin is then guided into the fourth passage 18 by the second sorting lever 17, and is deposited and accommodated in the coin tube 51.

Furthermore, in cases where it is judged on the basis of the detection signal of the discriminating sensor 11 that an inserted disk-form body is a genuine coin and is moreover a coin of type C, the control device (not shown in the figures) actuates the genuine/counterfeit sorting lever 12 on the basis of a judgement signal from the control device, so that the upstream end of the counterfeit coin discharge passage 13 is closed, and so that the upstream end of the first passage 14 is simultaneously opened. At the same time, the first sorting lever 15 is actuated so that the upstream end of the second passage 16 is opened and the upstream end of the third passage 20 is closed. Furthermore, the second sorting lever 17 is actuated so that the upstream end of the fourth passage 18 is closed and the upstream end of the fifth passage 19 is opened.

Accordingly, a coin of type C which is inserted into the coin insertion slot 3 so that this coin rolls through the discriminating passage 10 is guided into the first passage 14 by the genuine/counterfeit sorting lever 12, and is then guided into the second passage 16 by the first sorting lever 15. Furthermore, the coin is then guided into the fifth passage 19 by the second sorting lever 17, and is deposited and accommodated in the coin tube 52.

Furthermore, in cases where it is judged on the basis of the detection signal of the discriminating sensor 11 that an inserted disk-form body is a genuine coin and is moreover a coin of type B, the control device (not shown in the figures) actuates the genuine/counterfeit sorting lever 12 on the basis of a judgement signal from the control device, so that the upstream end of the counterfeit coin discharge passage 13 is closed, and so that the upstream end of the first passage 14 is simultaneously opened. At the same time, the first sorting lever 15 is actuated so that the upstream end of the second passage 16 is closed and the upstream end of the third passage 20 is opened. Furthermore, the third sorting lever 23 is actuated so that the upstream end of the sixth passage 21 is closed and the upstream end of the seventh passage 22 is opened. Moreover, the fourth sorting lever 26 is actuated so that the upstream end of the eighth passage 24 is closed and the upstream end of the ninth passage 25 is opened. Furthermore, the fifth sorting lever 27 is actuated so that the upstream end of the tenth passage 28 is opened and the upstream end of the eleventh passage 29 is closed.

Accordingly, a coin of type B which is inserted into the coin insertion slot 3 so that this coin rolls through the discriminating passage 10 is guided into the first passage 14 by the genuine/counterfeit sorting lever 12, and is then guided into the third passage 20 by the first sorting lever 15. Furthermore, the coin is then guided into the seventh passage 22 by the third sorting lever 23. Moreover, such a coin of type B that has been guided into the seventh passage 22 is further guided into the ninth passage 25 by the fourth sorting lever 26, and is then guided into the tenth passage 28 by the fifth sorting lever 27. This coin is then deposited and accommodated in the coin tube 53.

Furthermore, in cases where it is judged on the basis of the detection signal of the discriminating sensor 11 that an inserted disk-form body is a genuine coin and is moreover a coin of type D, the control device (not shown in the figures) actuates the genuine/counterfeit sorting lever 12 on the basis of a judgement signal from the control device, so that the upstream end of the counterfeit coin discharge passage 13 is closed, and so that the upstream end of the first passage 14 is simultaneously opened. At the same time, the first sorting lever 15 is actuated so that the upstream end of the second passage 16 is closed and the upstream end of the third passage 20 is opened. Furthermore, the third sorting lever 23 is actuated so that the upstream end of the sixth passage 21 is closed and the upstream end of the seventh passage 22 is opened. Moreover, the fourth sorting lever 26 is actuated so that the upstream end of the eighth passage 24 is closed and the upstream end of the ninth passage 25 is opened. Furthermore, the fifth sorting lever 27 is actuated so that the upstream end of the tenth passage 28 is closed and the upstream end of the eleventh passage 29 is opened.

Accordingly, a coin of type D which is inserted into the coin insertion slot 3 so that this coin rolls through the discriminating passage 10 is guided into the first passage 14 by the genuine/counterfeit sorting lever 12, and is then guided into the third passage 20 by the first sorting lever 15. Furthermore, the coin is then guided into the seventh passage 22 by the third sorting lever 23. Moreover, such a coin of type D that has been guided into the seventh passage 22 is further guided into the ninth passage 25 by the fourth sorting lever 26, and is then guided into the eleventh passage 29 by the fifth sorting lever 27. This coin is then deposited and accommodated in the coin tube 54.

In this coin processing device 1, when the numbers of coins of types A, C, B and D that have been accumulated and accommodated in the respective coin tubes 51, 52, 53 and 54 respectively exceed certain fixed numbers of accommodated coins, coins that are subsequently inserted via the coin insertion slot 3 are immediately accommodated in the cash box.

Incidentally, the fact that the respective numbers of coins accommodated in the respective coin tubes 51, 52, 53 and 54 have reached certain fixed numbers of coins is detected by respective overflow detection sensors that are disposed in the respective coin tubes 51, 52, 53 and 54.

For example, in cases where it has been detected by the overflow detection sensor (not shown in the figures) disposed in the coin tube 51 that the number of coins of type A that have been accumulated and accommodated in the coin tube 51 (which accommodates coins of type A) has reached a certain fixed number of coins, the abovementioned coin discrimination unit 4 performs the discriminating action described below.

If it is judged on the basis of the detection signal of the discriminating sensor 11 that a disk-form body that has been inserted via the coin insertion slot 3 so that the disk-form body passes through the discriminating passage 10 is a genuine coin, and is moreover a coin of type A, and if it is further detected by the overflow detection sensor of the coin tube 51 that the number of coins of type A that are accommodated in the coin tube 51 has reached a certain fixed number, the control device (not shown in the figures) actuates the genuine/counterfeit sorting lever 12 on the basis of these judgement signals so that the upstream end of the counterfeit coin discharge passage 13 is closed and the upstream end of the first passage 14 is opened. At the same time, the first sorting lever 15 is actuated so that the upstream end of the third passage 20 is opened and the upstream end of the second passage 16 is closed. At the same time, moreover, the control device actuates the third sorting lever 23 so that the upstream end of the sixth passage 21 is opened and the upstream end of the seventh passage 22 is closed.

Accordingly, a coin of type A which is inserted into the coin insertion slot 3 so that the this coin rolls through the discriminating passage 10 is guided into the first passage 14 by the genuine/counterfeit sorting lever 12, and the coin of type A is further guided into the third passage 20 by the first sorting lever 15. Furthermore, the coin of type A is guided into the sixth passage 21 by the third sorting lever 23, and is immediately accommodated inside the cash box (not shown in the figures).

Furthermore, when it has been detected by the overflow detection sensor (not shown in the figures) disposed in the coin tube 52 that the number of coins of type C that have been accumulated and accommodated in the coin tube 52 has reached a certain fixed number, or when it has been detected by the overflow detection sensor (not shown in the figures) disposed in the coin tube 53 that the number of coins of type B that have been accumulated and accommodated in the coin tube 53 has reached a certain fixed number, or when it has been detected by the overflow detection sensor (not shown in the figures) disposed in the coin tube 54 that the number of coins of type D that have been accumulated and accommodated in the coin tube 54 has reached a certain fixed number, the control device performs an operation similar to the abovementioned cash box accommodation operation for coins of type A.

Furthermore, in cases where it is ascertained on the basis of the detection signal of the discriminating sensor 11 that a disk-form body which has been inserted via the coin insertion slot 3 so that the disk-form body passes through the discriminating passage 10 is a genuine coin-type IC card X, the control device (not shown in the figures) actuates the genuine/counterfeit sorting lever 12 on the basis of a judgement signal from the control device, so that the upstream end of the counterfeit coin discharge passage 13 is closed and the upstream end of the first passage 14 is opened. At the same time, the first sorting lever 15 is actuated so that the upstream end of the second passage 16 is closed and the upstream end of the third passage 20 is opened. Moreover, the third sorting lever 23 is actuated so that the upstream end of the sixth passage 21 is closed and the upstream end of the seventh passage 22 is opened. Furthermore, the fourth sorting lever 26 is actuated so that the upstream end of the eighth passage 24 is opened and the upstream end of the ninth passage 25 is closed.

Accordingly, a genuine coin-type IC card X which has been inserted into the coin insertion slot 3 so that the coin-type IC card rolls through the discriminating passage 10 is guided into the first passage 14 by the genuine/counterfeit sorting lever 12, and is then guided into the third passage 20 by the first sorting lever 15, and afterward into the seventh passage 22 by the third sorting lever 23. Furthermore, the coin-type IC card X that has been guided into the seventh passage 22 is further guided into the eighth passage 24 by the fourth sorting lever 26.

Furthermore, as is shown in FIG. 3, the tip end 32*a* of the retention lever 32 constituting retention means 31 protrudes into the upstream portion of the eighth passage.

Accordingly, after the coin-type IC card X that has been guided into the eighth passage 24 passes through the hole 4*a* of the coin discrimination unit 4, the circumferential surface of the coin-type IC card X is supported by the tip end portion 32*a* of the retention lever 32 as shown in FIG. 4, so that the coin-type IC card X is retained.

Furthermore, the antenna coils 43 of the information input/output means 42 are disposed in positions located on both sides of the retained coin-type IC card X. Accordingly, the control device initiates the supply of electric power in a non-contact state, and the input and output of information into and from the retained coin-type IC card X, via these antenna coils 43.

In this case, the control device accesses the number of points, i.e., monetary information, stored beforehand in an IC module (not shown in the figures) that is embedded in the coin-type IC card X, and reads out the monetary information by means of the antenna coils 43; furthermore, the control device compares the read-out monetary information with monetary information that is required for a commercial transaction. Then, if the read-out monetary information shows a balance that is smaller than that of the monetary information required for the commercial transaction, the control device sends out a signal indicating that the read-out monetary information cannot be used in the commercial transaction. Furthermore, the control device performs processing in which monetary information acquired as a result of a commercial transaction is added to the read-out monetary information (addition of points), and rewrites the monetary information with a value resulting from this addition into the IC chip module.

Furthermore, if the read-out monetary information shows a balance that is greater than that of the monetary information required for the abovementioned commercial transaction, a permission signal indicating that the read-out monetary information can be used in the commercial transaction is sent out, and the balance of the monetary information used in the commercial transaction is subtracted from the balance of the read-out monetary information. Then, monetary information with a value resulting from this subtraction is rewritten into the IC chip module.

Furthermore, since the system that performs rewriting processing of monetary information into the abovementioned coin-type IC card X, i.e., input/output processing of information into and from the coin-type IC card, is fundamentally a system that adds monetary information obtained in a commercial transaction to monetary information stored in the coin-type IC card X, this system is referred to as a point system of the so-called point-addition-type.

Furthermore, when the input/output processing of information into or from the coin-type IC card X by such a control device (not shown in the figures) is completed, the control device next switches on the solenoid 33 of the retention means 31 as shown in FIG. 5. As a result, the tip end 32*a* of the retention lever 32 is retracted from the eighth passage 24 against the driving force of the spring 34, so that the upstream end of the eighth passage is opened.

Accordingly, the coin-type IC card X which had been retained by the retention lever 32 up to this point is guided toward the downstream portion of the eighth passage 24 as shown in FIG. 6, and is paid out from the coin pay-out slot after passing through the abovementioned counterfeit coin discharge chute.

Furthermore, after the coin-type IC card X has been guided toward the downstream portion of the eighth passage 24, the control device (not shown in the figures) switches the solenoid 33 in FIG. 6 off; accordingly, the tip end 32*a* of the retention lever 32 is caused to protrude into the upstream portion of the eighth passage 24 by the driving force of the spring 34. As a result, the system returns to the initial state shown in FIG. 3, in which the upstream end of the eighth passage 24 is closed.

Furthermore, the reference symbol 24*a* in FIGS. 2 through 6 indicates a passage portion of the eighth passage 24 which causes the eighth passage 24 (disposed inside the auxiliary tube 7) to communicate with the abovementioned counterfeit coin discharge chute, and the reference symbol 7*b* in FIGS. 3 through 6 indicates a hole which is formed in the abovementioned auxiliary tube 7 in order to dispose the eighth passage 24 inside the auxiliary tube 7.

When a person first uses an automatic vending machine in which the coin processing device 1 is installed, the person does not have a coin-type IC card, and therefore no coin-type IC card X is inserted via the coin insertion slot 3. In that case, the control device (not shown in the figures) provided in the vending machine pays out a coin-type IC card X which has been accommodated beforehand in the auxiliary tube 7, via the coin pay-out slot by means of the coin pay-out unit 6. This paid-out coin-type IC card X stored beforehand a predetermined monetary information in the form of a number of points (i.e., a number of points are added), which serves as an incentive for the person to use the machine in subsequent occasions. In the subsequent occasions of using the machine, the person may take advantage of this stored monetary information (number of points).

This control device may be of a type in which a person to buy goods can choose whether a coin-type IC card X accommodated in the auxiliary tube 7 device is to be paid out or not. This choice can be done by the operation of a selection button which will cause the coin pay-out unit 6 to perform, in a selective manner, the operation of paying out on the basis of switching signals of the selection button.

Notice should be taken that this coin processing device 1 of this embodiment can process various types of coins and coin-type IC cards individually and respectively in cases where a mixture of various types of coins and coin-type IC cards X is inserted via the coin insertion slot 3.

In cases where a plurality of coin-type IC cards X are inserted via the coin insertion slot 3 in a single commercial transaction in the coin processing device 1 of this embodiment, only the coin-type IC card that is inserted first into the coin insertion slot 3 is judged to be a genuine coin-type IC card, and processing such as the input or output of the abovementioned information is performed only for the coin-type IC card X. The rest of the coin-type IC cards X that are inserted into the coin insertion slot 3 afterward are all judged to be counterfeit coin-type IC cards, and are paid out from the coin pay-out slot with no input/output processing of information being performed for these coin-type IC cards and the coin-type IC cards.

As was described above, the coin processing device 1 is so constructed that the genuine or counterfeit nature and denomination of coins of type A, coins of type B, coins of type C and coins of type D are ascertained, coins that have been ascertained to be genuine are accommodated according to denomination, and these accommodated coins are paid out from a coin pay-out slot according to the amount of change, coin-type IC card processing means 41 are provided for ascertaining the genuine or counterfeit nature of inserted coin-type IC cards X, performing the input and output of information into and from coin-type IC cards X that have been ascertained to be genuine, and discharging these coin-type IC cards X from the coin pay-out slot. As a result, the coin processing device 1 can process coins of types A, B, C and D and coin-type IC cards X by a single coin processing device.

In cases where the point system is introduced into an automatic vending machine, it is necessary to input and output monetary information into and from point cards. However, since conventional coin processing devices process only coins, a special reader-writer which performs the input and output of information into and from the card is newly installed inside the automatic vending machine independently of the conventional coin processing device in such cases. As a result, installation space must be provided for the reader-writer inside the automatic vending machine. Accordingly, depending on the type of automatic vending machine involved, it may be impossible in some cases to provide such installation space, so that the abovementioned point system cannot be introduced. Furthermore, rebuilding of the interior portion of the automatic vending machine may be necessary, so that the introduction of the point system is difficult.

On the other hand, in the coin processing device according to an embodiment of the present invention, coins of types A, B, C and D and coin-type IC cards X constituting point cards can be processed by a single coin processing device as was described above. Accordingly, there is no need to install a special reader-writer separately from the coin processing device 1 as there is in cases where the point system is introduced into a conventional automatic vending machine. Consequently, since there is no need to provide installation space for such a reader-writer inside the automatic vending machine, the conventional problem of the introduction of the point system being impossible in the case of some types of automatic vending machines due to considerations regarding the installation space for the reader-writer is effectively solved. Accordingly, the point system can be introduced into all types of automatic vending machines, and there is no need to rebuild the interior of the automatic vending machine when the point system is introduced. Consequently, this introduction of the point system can be greatly simplified.

Accordingly, the present invention makes it possible to provide a coin processing device which allows the simple introduction of the point system into all types of automatic vending machines.

Furthermore, the abovementioned conventional problems, i.e., the problem of the impossibility of introducing the point system into some types of automatic vending machines because of the inability to provide installation space for a special card reader-writer, and the problem of the difficulty of introducing the point system because of the need to rebuild the interior of the automatic vending machine, have been one factor inhibiting the spread of the point system in conventional automatic vending machines. The coin processing device according to the present invention can solve the abovementioned problems. With the coin processing device according to the present invention, accordingly, spread of the point system in automatic vending machines can also be promoted.

Furthermore, if the coin-type IC card processing means 41 are constructed with coin-type IC card accommodating means and coin-type IC card pay-out means provided as in the coin processing device 1 of the present embodiment, the coin-type IC card accommodating means and coin-type IC card pay-out means can be installed inside the coin processing device 1. As a result, the size of the automatic vending machine can be correspondingly reduced.

Furthermore, by utilizing the auxiliary tube 7 inside the coin processing device 1 as the coin-type IC card accommodating means in the coin processing device 1 of the present embodiment, coin-type IC cards X accommodated in the auxiliary tube 7 can be paid out by the coin pay-out unit 6, so that there is no need to install coin-type IC card accommodating means or coin-type IC card pay-out means separately from the coin accommodating unit 5 and coin pay-out unit 6 inside the coin processing device 1. As a result, the size of the coin processing device can be reduced.

Furthermore, in the coin processing device 1 of the present embodiment, a so-called point-addition-type point system is employed. However, the coin processing device of the embodiment is not limited to a coin processing device using a point-addition-type point system, but may also be a coin processing device using a so-called point-subtraction-type point system in which monetary information involved in a commercial transaction is as a rule subtracted from monetary information stored in the coin-type IC card X.

Furthermore, in the coin processing device 1 of the present embodiment, point information was described as monetary information. However, it goes without saying that the coin processing device 1 can also be utilized in a point system which is devised so that points are added and can be exchanged for prizes when a certain number of points is reached, or so that the points can be used to play in a lottery for prizes.

Furthermore, in the coin processing device 1 of the present embodiment, the device is constructed so that the genuine or counterfeit nature of coin-type IC cards X is ascertained by a discriminating sensor 11, and genuine coin-type IC cards X are guided into the coin-type IC card processing means 41. However, in the coin processing device of this embodiment of the present invention, the means used to ascertain the genuine or counterfeit nature of coin-type IC cards X are not limited to such a discriminating sensor 11. Alternatively, for example, it may be so constructed that after the type of the coin-type IC card X has been ascertained by the discriminating sensor 11, information is read out or written into the coin-type IC card X by the information input/output means 42 of the coin-type IC card processing means 41, and at that time the genuine or counterfeit nature of the coin-type IC card X is ascertained.

The coin processing device 1 of the present embodiment was devised as a coin processing device for the point system which can process coins of types A, B, C and D and coin-type IC cards X as a result of the installation of coin-type IC card processing means 41. However, since a coin insertion slot 7*a* to insert coins with a high frequency of use into the auxiliary tube 7 is formed in the auxiliary tube 7 positioned in the downstream portion of the passage 24, it goes without saying that the coin processing device 1 of the present embodiment can also be used as a conventional coin processing device which does not employ the point system by inserting the coins with a high frequency of use into the auxiliary tube 7 via the coin insertion slot 7*a*.

What is claimed is:

1. A coin processing device which ascertains genuine or counterfeit nature and denomination of inserted coins, accommodates coins that have been ascertained to be genuine according to denomination, and pays out the accommodated coins via a coin pay-out slot according to amount of change, comprising:

an auxiliary tube which accommodates coins with a high frequency of use; and coin-type IC card processing means for ascertaining genuine or counterfeit nature of inserted coin-type IC cards, performing input and output of information into and from coin-type IC card that have been ascertained to be genuine, and discharging the coin-type IC cards from the coin pay-out slot, wherein the coin-type IC card processing means comprise:

discriminating means for ascertaining the genuine or counterfeit nature and denomination of the inserted coins, and ascertaining the genuine or counterfeit nature of the coin-type IC cards;

sorting means comprising a sorting lever for sorting the genuine coins and the genuine coin-type IC cards into respective separate passages, and for guiding the coin-type IC cards that have been ascertained to be genuine into a first passage for coin-type IC cards that communicates with the coin pay-out slot; and information input/output means for inputting and outputting information into and from the genuine coin-type IC cards, the information input/output means being disposed at an intermediate point in the first passage, and wherein a part of the first passage is disposed within the auxiliary tube, the information input/output means comprises retention means for retaining the coin-type IC card, and is disposed in the part of the first passage disposed within the auxiliary tube, and the coin-type IC card is retained in the part of the first passage disposed within the auxiliary tube, whereby information is input into and output from the coin-type IC card.

* * * * *